US008900680B2

(12) United States Patent
Nilsson

(10) Patent No.: US 8,900,680 B2
(45) Date of Patent: Dec. 2, 2014

(54) PACKAGING MATERIAL COMPRISING MAGNETISABLE PORTIONS

(75) Inventor: Tommy Nilsson, Eslöv (SE)

(73) Assignee: Tetra Laval Holdings & Finanace S.A., Pully (CH)

( * ) Notice: Subject to any disclaimer, the term of this patent is extended or adjusted under 35 U.S.C. 154(b) by 99 days.

(21) Appl. No.: 13/322,594

(22) PCT Filed: May 11, 2010

(86) PCT No.: PCT/SE2010/000132
§ 371 (c)(1),
(2), (4) Date: Nov. 28, 2011

(87) PCT Pub. No.: WO2010/138054
PCT Pub. Date: Dec. 2, 2010

(65) Prior Publication Data

US 2012/0067953 A1 Mar. 22, 2012

(30) Foreign Application Priority Data

May 29, 2009 (SE) ..... 0900737

(51) Int. Cl.
*B65B 61/02* (2006.01)
*B31B 1/74* (2006.01)
*B31B 1/88* (2006.01)

(52) U.S. Cl.
CPC ..... *B31B 1/88* (2013.01); *B31B 2201/88* (2013.01); *B31B 2201/95* (2013.01); *B31B 1/74* (2013.01)
USPC ..... 428/35.7; 324/207.21; 324/207.24

(58) Field of Classification Search
USPC ..... 428/35.7; 53/51, 131.2, 135.2, 141, 53/168, 505
See application file for complete search history.

(56) References Cited

U.S. PATENT DOCUMENTS

| | | | |
|---|---|---|---|
| 3,237,973 | A | 3/1966 | Rumberger |
| 5,288,361 | A | 2/1994 | Konno |
| 6,079,188 | A | 6/2000 | Katayama et al. |
| 6,247,293 | B1 | 6/2001 | Todd et al. |
| 2005/0287351 | A1 | 12/2005 | Johansson et al. |

(Continued)

FOREIGN PATENT DOCUMENTS

| | | | |
|---|---|---|---|
| EP | 0 488 055 | A1 | 6/1992 |
| EP | 0 705 759 | A1 | 4/1996 |

(Continued)

OTHER PUBLICATIONS

International Search Report (PCT/ISA/210) issued on Sep. 9, 2010, by Swedish Patent Office as the International Searching Authority for International Application No. PCT/SE2010/000132.

(Continued)

*Primary Examiner* — Ellen S Raudenbush
(74) *Attorney, Agent, or Firm* — Buchanan Ingersoll & Rooney

(57) ABSTRACT

A packaging material comprises a plurality of magnetisable portions thereon, the magnetisable portions comprising at least one spot per package to be formed from the packaging laminate. The packaging material further comprises at least one preparation feature for enhancing finishing of packages, wherein the at least one preparation feature is aligned with a magnetic field mark in the at least one magnetisable portion. Methods for writing and reading, respectively, a magnetic mark on a packaging material are also disclosed.

15 Claims, 1 Drawing Sheet

(56) References Cited

U.S. PATENT DOCUMENTS

| | | | |
|---|---|---|---|
| 2006/0032928 | A1 | 2/2006 | Schaedel |
| 2008/0309327 | A1 | 12/2008 | Holmstrom |
| 2012/0070633 | A1 | 3/2012 | Nilsson et al. |
| 2012/0070634 | A1 | 3/2012 | Holmström |
| 2012/0070638 | A1 | 3/2012 | Nilsson et al. |
| 2012/0073242 | A1 | 3/2012 | Nilsson et al. |
| 2012/0074234 | A1 | 3/2012 | Nilsson et al. |
| 2012/0076995 | A1 | 3/2012 | Nilsson et al. |
| 2012/0077001 | A1 | 3/2012 | Klint et al. |

FOREIGN PATENT DOCUMENTS

| | | | |
|---|---|---|---|
| EP | 0 999 134 | A2 | 5/2000 |
| EP | 1914168 | * | 10/2006 |
| JP | H05-222647 | A | 8/1993 |
| JP | H06-13223 | A | 1/1994 |
| JP | H07-281306 | A | 10/1995 |
| JP | H08-324504 | A | 12/1996 |
| JP | 2001-187154 | A | 7/2001 |
| JP | 2005-525253 | A | 8/2005 |
| JP | 2008-532039 | A | 8/2008 |
| WO | 95/00393 | A1 | 1/1995 |
| WO | WO 03/095198 | A1 | 11/2003 |
| WO | WO2006135313 | * | 12/2006 |

OTHER PUBLICATIONS

European Communication (Extended European Search Report) dated Mar. 12, 2014 issued in the corresponding European Patent Application No. 10780875.0-1708.

* cited by examiner

PACKAGING MATERIAL COMPRISING MAGNETISABLE PORTIONS

TECHNICAL FIELD

The present invention relates to a packaging material comprising magnetisable portions, wherein the material is intended for forming e.g. food packages.

BACKGROUND

Within packaging technology where a packaging container is formed from a packaging laminate, it is known to provide the packaging laminate as a web which prior or during packaging is formed to the packaging container. Guiding marks, e.g. for optical reading has been provided to guide operations when finishing the package, such as forming, sealing, folding, etc. Such guiding marks are sometimes referred to as register marks. The register mark for optical reading is provided during printing of the packing laminate, where e.g. decoration or product information is printed on the packaging laminate. A problem with such register marks is that they consume a non-negligible area of what becomes the exterior of the package. A further problem is that such a register mark has to rely on the printing being well aligned with other operations performed on the web. It is therefore a desire to provide an improved provision of marking of web of packaging laminate.

SUMMARY

The present invention is based on the understanding that magnetic marking can be provided on a packaging laminate. Storing information in a magnetic recording medium in packing material has been suggested in e.g. EP 705759 A1. In the present disclosure, it is suggested that one or more spots per intended package to be formed from the web is provided on the web, wherein the spots comprises magnetisable particles such that magnetic marking is enabled.

According to a first aspect, there is provided a packaging material comprising a plurality of magnetic marks printed thereon comprising at least one magnetic mark per package to be formed from the packaging material, said at least one magnetic mark being aligned with a preparation feature associated with an operation to be made to finish packages, wherein said at least one magnetic mark is positioned on the material such that relative speed between the material and means for reading the magnetic mark is varying , non-zero, during reading.

The preparation feature may comprise any of a group comprising crease lines, openings, perforations, package boundary or sealing, beginning of web, end of web, positioning of optical mark, print for package outside.

A distance between an area of a preparation feature and its aligned magnetic field mark may be at least 2 mm, preferably at least 5 mm, preferably at least 7 mm, preferably at least 10 mm.

At least one of the spots for each package to be formed may be positioned not more than 20%, preferably between 5 and 15% of the width of the material to form a package from a longitudinal edge of the material to form the package.

In one embodiment of the invention there is provided a packaging material comprising a magnetic mark providing a magnetic field pattern and being aligned with an operation for applying an opening device on the packaging material, wherein said magnetic mark is positioned on the material such that relative speed between the material and means for writing the magnetic mark is constant during writing.

The magnetic field pattern may comprise a first magnetic field peak having a first polarity and a second magnetic field peak having a second opposite polarity. The material may define a transversal direction being parallel to an imaginary axis of a roll when a web of the material is spooled, a longitudinal direction perpendicular to the transversal direction, and an imaginary line between a midpoint of the first peak and the second peak of the magnetic field pattern, wherein the magnetic field pattern may be arranged such that the angle between the imaginary line and the longitudinal direction is between −10 and 10 degrees, preferably between −5 and 5 degrees, preferably about 0 degrees. The peaks of the magnetic pattern may have a distribution forming a substantially constant magnetic field along a width of the magnetic pattern in a direction perpendicular to the imaginary line, and forming a strongly decreasing magnetic field outside the width of the magnetic pattern in the direction perpendicular to the imaginary line. The width may be at least 2 mm, preferably at least 4 mm, preferably at least 6 mm.

The magnetic field pattern may comprise a first magnetic field peak having a first polarity and a second magnetic field peak being distributed such that it encircles the first peak and having a second opposite polarity.

The relative speed may be zero at writing of the magnetic mark, and may be non-zero at reading of the magnetic mark. Thus, at writing of the magnetic mark, there is no slip between the writing means and the packaging material, which implies that the magnetic mark is accurately assigned. At reading of the magnetic mark, there is a movement between the reading means and the magnetic mark such that the pattern of the magnetic mark can be properly detected. In case where the packaging material is intended for manufacturing of packaging containers by means of a packaging machine operating in an indexing manner said at least one magnetic mark is preferably located on the packaging material such that it is detected when the travelling speed of the packaging material is at least 50% of its maximum value to obtain a perfect detection of the magnetic mark.

According to a second aspect, there is provided a method for reading a magnetic mark from a packaging material according to the first aspect. The method comprises controlling a relative speed between reading means and the material to be non-zero. Preferably, the relative speed between the reading means and the material is controlled to be at least 50% of its maximum value in case where the packaging material is traveling in a cycling or indexing manner through a packaging machine of the kind which forms, fills and seals packages in a continuous manner from the packaging material passing therethrough. The controlling of the relative speed may comprise providing a slacking portion of the material both before and after the reading position such that speed at the writing position is enabled to be constant at instant of reading irrespective of general speed variations of the material.

DETAILED DESCRIPTION

Figure 1:
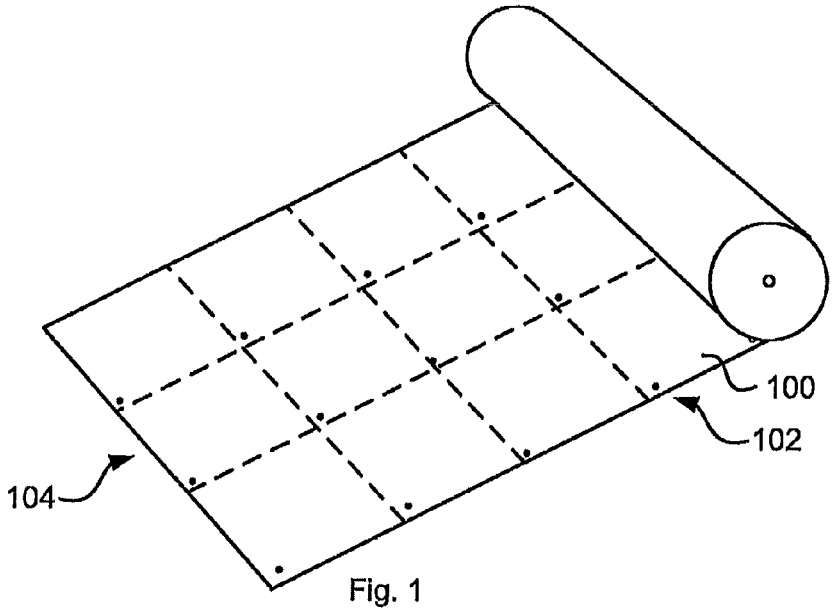
FIG. 1 schematically illustrates a web of packaging laminate according to an embodiment.

FIG. 1 illustrates web 100 of packaging material, where a plurality of magnetisable portions 102 are provided. The magnetisable portions are preferably distributed upon printing them such that there is at least one magnetisable portion 102 per package 104 to be formed from the packaging material. The dashed lines are imaginary and are intended to show the plurality of parts that will form the packages. For reducing the consumption of magnetisable material, e.g. magnetisable ink consumption, the magnetisable portions are provided as spots or the like at parts where magnetic marks are intended to be positioned. Since there is a limited precision in positioning between printing and the assignment of the magnetic mark, cf. the problem with optical marks, the spots are preferably slightly larger than the actual size needed for the magnetic mark. Thus, any reasonable deviation can be handled. The spots are thus provided with magnetisable particles, which can be provided with magnetic marks, and, as will be further elucidated below, depending on the form and size of the spots, be provided with more complex information by modulated magnetisation. The packaging material is preferably a laminate, or a single layer material such as a polymer material.

Figure 2:
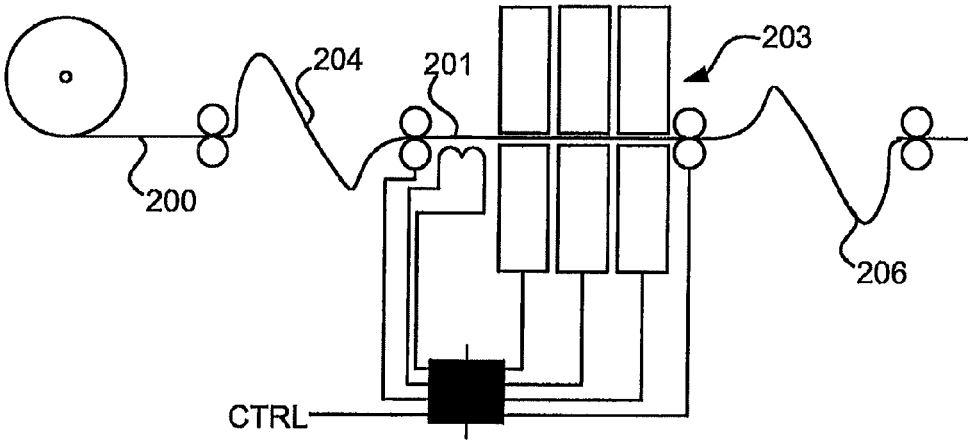
FIG. 2 schematically illustrates an example of position reading/writing aligned with operations on a web of packaging material.

FIG. 2 schematically illustrates an example of position reading/writing of a magnetic mark aligned with one or more operations 203 on a web 200 of packaging material. A magnetic mark 201 is used for alignment of the one or more operations. To enable proper positioning of the webs for the operations, and to provide a constant movement, i.e. without accelerations or decelerations of the material, or a zero movement, slacks 204, 206 before and after the position of reading/writing/operations can be provided.

Further, at least one preparation feature for enhancing finishing of packages can be provided by the web. The at least one preparation feature can be aligned with a magnetic field mark in the at least one magnetisable portion. For example, crease lines are made in the web for enabling a swift and reliable finishing of the package. The preparation feature can be other than provision of crease lines, such as providing openings, perforations, etc. The alignment follows the same principle, i.e. that the magnetising portion is provided at the mechanism providing the preparation feature such that the alignment will be inherent because of the structure.

The application of the magnetising element in the mechanism performing the preparation feature may arise a few issues. The magnetising element may for example not be provided at a position where the preparation feature demands a mechanical interaction with the packaging laminate, such as forming a crease line or punching a hole. Therefore, there is preferably provided a distance between an area of such a preparation feature and its aligned magnetic field mark. Further, the tool performing the interaction as mentioned above may be made of a ferromagnetic material. To improve the application of the magnetic field mark, the magnetising element may need to be provided with a holding or mounting means made of a non-ferromagnetic material, such as aluminum, wherein the distance may be further increased. Thus, depending on the preparation feature operation, and the tool for performing it, the distance is preferably for example at least 2 mm, at least 5 mm, at least 7 mm, or at least 10 mm.

As several operations performing feature preparations, it is preferable that each such operation have its aligned magnetic field mark. Those different magnetic field marks are each preferably made in a respective magnetisable portion adapted in position for the operation. As some operations may be interacting, one operation can use a magnetic field mark made by another operation as a master mark, or there may be provided a certain dedicated master mark that is not inherently aligned with any feature preparating operation, which thus only is used for reference by later performed operations.

Other magnetic field marks may hold complex data, and can for example be provided as long rectangular spots, i.e. as strips. The strips can be provided along the entire web, with or without interruptions at parts intended to be cut upon finishing the packages. The magnetic field marks holding complex data can for example provide a unique code from which the web, and also the part of the web, can be identified. The complex data can also give position information, indications for the finishing of the package, etc.

A further position information can be package boundary or sealing, where an operation is for dividing the web into the parts forming the package, or for the sealing of respective package.

A further position information, that the magnetisable portion can hold, is magnetic position marks at ends of a web of the packaging material, i.e. beginning of web and/or end of web, such that, at splicing of the webs, the splice is enabled to be aligned.

A further position information is positioning of an optical mark, which may beneficial compatibility for packaging machines having either optical reading or magnetic reading of positioning information. Preferably, the position of the spot holding this information is positioned similar to the optical mark, but on the side that is intended to become the inside of the package. Since the optical marks normally is provided on the part intended to form the bottom of the package, the corresponding magnetisable portion is positioned accordingly. A magnetic mark at this magnetisable portion is thus enabled to provide the similar information as the optical mark, and the optical reader of a packaging machine can thus simply be replaced with a magnetic reader. In practise, no optical mark is thus necessary if the optical readers are replaced by magnetic readers, and the magnetic mark takes the place of the optical mark as described above. In that case, the compatibility lies in the sense of the same mounting position of the readers in the packaging machine.

A further position information can be for a print for the package outside. This position information can be beneficial for ensuring proper alignment of the print with the package, and with other feature preparations of the package.

Upon making the magnetic field mark, it can be beneficial that the means for writing the magnetic field mark, e.g. a permanent magnet or a coil arrangement, has no or little relative movement, or at least an approximately constant relative movement to the magnetisable portion. This is achieved for example by integrating the writing means in e.g. rolls for making the crease lines, wherein there is no relative movement since the periphery of the rolls and the web moves by the same speed in the same direction. Another way of achieving no or little relative movement, or at least an approximately constant relative movement to the magnetisable portion is to control the movement at the position of the writing. This can be done by having a slacking portion of the web both before and after the writing position such that speed at this position can be controlled irrespective of the speed of the web before and after that position. The slack can be achieved by letting the web move along a wave-formed path where the sizes of the waves are adaptable to give a variable slack. Thus, during the writing operation, the speed can be controllable at the writing position, and the web is accelerated or decelerated between the writing operations to adapt to the average speed of the web.

Upon reading the magnetic field mark, it can be beneficial that the means for reading the magnetic field mark, e.g. a coil arrangement, has an approximately constant relative movement to the magnetisable portion. A way of achieving the approximately constant relative movement to the magnetisable portion is to control the movement at the position of the reading. This can be done by having a slacking portion of the web both before and after the reading position such that speed at this position can be controlled irrespective of the speed of the web before and after that position. The slack can be achieved by letting the web move along a wave-formed path where the sizes of the waves are adaptable to give a variable slack. Thus, during the reading operation, the speed can be controllable at the reading position, and the web is accelerated or decelerated between the reading operations to adapt to the average speed of the web.

Thus, there are provided methods for writing and reading, respectively, the magnetic mark according to the discussion above. For writing of the magnetic mark, the benefit of having a zero relative speed between the writing means and the material is that the positioning of the mark can be very accurate, and that the pattern of the mark becomes as intended since there is no slip. For reading of the magnetic mark, the benefit of having a constant non-zero relative speed is that the magnetic pattern of the mark can be properly read. In this context, zero and non-zero should be construed in view of the dynamics of the processes of material movement and the time it takes for reading and writing. Thus, "zero" (and thus "non-zero") is not to be construed as absolute, and not to be construed as a permanent condition since it is only a desired state at the very moment of reading or writing.

At least one of the spots for each package to be formed can be positioned not more than 20%, preferably between 5 and 15% of the width of the material to form a package from a longitudinal edge of the material to form the package. A magnetic field mark at such spots can then be used for controlling twisting of the material when forming the package. The forming of the package is normally made by forming some kind of tube which then is sealed in some way at its ends and formed into the desired shape. The tube can then be unintentionally twisted, which can jeopardize the forming of the package. Therefore, such a magnetic field mark can help to control any twisting of the tube to ensure forming of the package. By having these magnetic marks relatively close to the longitudinal edges to be joined to form the tube, the control is further enhanced since the reading of the magnetic field marks can be made from the side of the package where the joining takes place.

Considering a web of packaging material comprising a plurality of magnetisable portions thereon, wherein at least one spot per package to be formed from the packaging laminate is comprised, at least one of the magnetisable portions can provide a magnetic mark carrying a magnetic field pattern. Thus, the magnetic mark becomes an information carrier. The information carried is geometrical in the sense that it is made on a particular position on the web, which is maintained through different processing steps, from manufacturing of the web to the finishing of the package. The information can also be in the sense of a pattern of the magnetic field, which can be a rather simple pattern for reliable position detection, or a more complex pattern for carrying complex data.

The magnetic field pattern can comprise a first magnetic field peak having a first polarity and a second magnetic field peak having a second opposite polarity. Such a magnetic field pattern can be achieved by a single magnet, e.g. a permanent magnet having a north and a south pole, being arranged close to the magnetisable portion during application of the magnetic mark, such that the remaining magnetic field of the magnetic particles of the magnetic ink of the magnetisable portion becomes as desired. The position in a longitudinal direction is then preferably detected by observing the shift of the magnetic field, e.g. zero-crossing, which can provide a very accurate position indication in the longitudinal direction. The position in a transversal direction is preferably detected by observing flanks of the magnetic field, e.g. by differential measurements technique, which will enable accurate tracking in the transversal direction.

The pattern illustrated is preferably aligned with the longitudinal or transversal direction. However, such a perfect alignment is not necessary. Considering an imaginary line between a midpoint of the first peak and the second peak of the magnetic field pattern, the magnetic field pattern can be arranged such that the angle between the imaginary line and e.g. the longitudinal direction is between −10 and 10 degrees. In a preferred embodiment, the angle is between −5 and 5 degrees. The peaks of the magnetic pattern can have a distribution forming a substantially constant magnetic field along a width of the magnetic pattern in a direction perpendicular to the imaginary line, and forming a strongly decreasing magnetic field outside the width of the magnetic pattern in the direction perpendicular to the imaginary line. The width is preferably at least 2 mm to enable detection of the flanks without interference. For higher reliability, the width is preferably at least 4 mm, and for some applications preferably at least 6 mm.

According to another embodiment of assignment of magnetic field pattern, the magnetic field pattern comprises a first magnetic field peak having a first polarity and a second magnetic field peak being distributed such that it encircles the first peak and having a second opposite polarity. Observing this magnetic field pattern in longitudinal and transversal directions will show the symmetric properties of the magnetic field pattern. Thus, detection according to the same principle can be made in any direction. For example, zero-crossings of the magnetic field can be observed using differential measurement technology. Another example is simply observing a main center peak of the magnetic field pattern.

The invention claimed is:

1. A packaging material comprising a plurality of magnetic marks printed thereon comprising at least one magnetic mark per package to be formed from the packaging material, and said at least one magnetic mark providing a magnetic field pattern and being aligned with a preparation feature associated with an operation to be made to finish packages, wherein said at least one magnetic mark is positioned on the material such that relative speed between the material and means for reading the magnetic mark is varying, nonzero during reading, wherein the magnetic field pattern comprises a first magnetic field peak having a first polarity and a second magnetic field peak having a second opposite polarity, and wherein the material defines a transversal direction parallel to an imaginary axis of a roll when a web of the material is spooled, a longitudinal direction perpendicular to the transversal direction, and an imaginary line between a midpoint of the first peak and the second peak of the magnetic field pattern, and the magnetic field pattern is arranged such that the angle between the imaginary line and the longitudinal direction is between −10 and 10 degrees.

2. The material according to claim 1, wherein the preparation feature comprises any of a group comprising crease lines, openings, perforations, package boundary or sealing, beginning of web, end of web, positioning of optical mark, print for package outside.

3. The material according to claim 1, wherein a distance between an area of the preparation feature and its aligned magnetic field mark is at least 2 mm.

4. The material according to claim 1, wherein at least one of the magnetic marks for each package to be formed is positioned not more than 20% of the width of the material to form the package from a longitudinal edge of the material to form the package.

5. The material according to claim 1, wherein the peaks of the magnetic pattern have a distribution forming a substantially constant magnetic field along a width of the magnetic pattern in a direction perpendicular to the imaginary line, and forming a strongly decreasing magnetic field outside the width of the magnetic pattern in the direction perpendicular to the imaginary line.

6. The material according to claim 5, wherein the width is at least 2 mm.

7. A packaging material comprising a plurality of magnetic marks printed thereon comprising at least one magnetic mark per package to be formed from the packaging material, said at least one magnetic mark providing a magnetic field pattern and being aligned with a preparation feature associated with an operation to be made to finish packages, wherein said at least one magnetic mark is positioned on the material such that relative speed between the material and means for reading the magnetic mark is non-zero during reading, wherein the magnetic field pattern comprises a first magnetic field peak having a first polarity and a second magnetic field peak having a second opposite polarity, the material defines a transversal direction parallel to an imaginary axis of a roll when a web of the material is spooled, a longitudinal direction perpendicular to the transversal direction, and an imaginary line between a midpoint of the first peak and the second peak of the magnetic field pattern, and the magnetic field pattern is arranged such that the angle between the imaginary line and the longitudinal direction is between −10 and 10 degrees.

8. A packaging material according to claim 7 for manufacturing of formed, filled and sealed packages by means of a packaging machine through which the packaging material is passed in an indexing or speed-varying manner, wherein said at least one magnetic mark is positioned on the magnetic material such that the relative speed between the material and means for reading the magnetic mark is at least 50% of its maximum value during reading.

9. The material according to claim 1, wherein a distance between an area of the preparation feature and its aligned magnetic field mark is at least 10 mm.

10. The material according to claim 1, wherein at least one of the magnetic marks for each package to be formed is positioned between 5 and 15% of the width of the material to form the package from a longitudinal edge of the material to form the package.

11. The material according to claim 1, defining a transversal direction being parallel to an imaginary axis of a roll when a web of the material is spooled, a longitudinal direction perpendicular to the transversal direction, and an imaginary line between a midpoint of the first peak and the second peak of the magnetic field pattern, wherein the magnetic field pattern is arranged such that the angle between the imaginary line and the longitudinal direction is about 0 degrees.

12. The material according to claim 5, wherein the width is at least 6 mm.

13. The material according to claim 2, wherein a distance between an area of the preparation feature and its aligned magnetic field mark is at least 2 mm.

14. The material according to claim 2, wherein at least one of the magnetic marks for each package to be formed is positioned not more than 20% of the width of the material to form the package from a longitudinal edge of the material to form the package.

15. A packaging material comprising a plurality of magnetic marks printed thereon comprising at least one magnetic mark per package to be formed from the packaging material, said at least one magnetic mark providing a magnetic field pattern and being aligned with a preparation feature associated with an operation to be made to finish packages, wherein said at least one magnetic mark is positioned on the material such that relative speed between the material and means for reading the magnetic mark is non-zero during reading, wherein the magnetic field pattern comprises a first magnetic field peak having a first polarity and a second magnetic field peak being distributed such that it encircles the first peak and having a second opposite polarity, wherein the material defines a transversal direction parallel to an imaginary axis of a roll when a web of the material is spooled, a longitudinal direction perpendicular to the transversal direction, and an imaginary line between a midpoint of the first peak and the second peak of the magnetic field pattern, and the magnetic field pattern is arranged such that the angle between the imaginary line and the longitudinal direction is between −10 and 10 degrees.

* * * * *